US007892028B2

(12) United States Patent
Wu

(10) Patent No.: US 7,892,028 B2
(45) Date of Patent: Feb. 22, 2011

(54) CABLE CONNECTOR ASSEMBLY

(75) Inventor: Chun-Kwan Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/609,045

(22) Filed: Oct. 30, 2009

(65) Prior Publication Data

US 2010/0184330 A1 Jul. 22, 2010

(30) Foreign Application Priority Data

Jan. 20, 2009 (TW) ..... 98101967 A
Feb. 23, 2009 (TW) ..... 98105669 A

(51) Int. Cl.
*H01R 13/648* (2006.01)

(52) U.S. Cl. ..... 439/607.28; 439/579; 439/581

(58) Field of Classification Search ..... 439/607.28, 439/579, 578, 675, 63, 580, 581
See application file for complete search history.

(56) References Cited

U.S. PATENT DOCUMENTS 6,146,196 A * 11/2000 Burger et al. ..... 439/578
6,641,435 B1 11/2003 Ko

* cited by examiner

*Primary Examiner*—Javaid Nasri
(74) *Attorney, Agent, or Firm*—Wei Te Chung; Andrew C. Cheng; Ming Chieh Chang

(57) ABSTRACT

A cable connector (100) includes an insulative housing (30), at least one terminal (70) received in the insulative housing, a metal cover (10) shielding the insulative housing and at least one cable (50) connecting with the at least one terminal. The cable includes a central conductor (507) and a braiding layer (503) coaxially surrounding the central conductor. The braiding layer of the cable and the metal cover are connected with each other by conductive adhesive (90).

8 Claims, 14 Drawing Sheets

CABLE CONNECTOR ASSEMBLY

CROSS-REFERENCE TO RELATED APPLICATIONS

This patent application relates to a co-pending U.S. patent application Ser. No. 12/569,902, filed on Sep. 30, 2009, entitled "CABLE CONNECTOR ASSEMBLY WITH GROUNDING DEVICE", which has the same inventor and is assigned to the same assignee with this application.

BACKGROUND OF THE INVENTION

1. Field of the Invention

The present invention relates generally to a cable connector assembly, and more particularly to a cable connector assembly having better grounding performance.

2. Description of Related Arts

Micro coaxial cable connectors are widely used in mobile phone, which is well known to persons skilled in the art. The traditional micro coaxial cable connector transmits signals with lower frequency depending upon its own structure. Accompanying with multi-functions of people, such as Global Position System (GPS), the micro coaxial cable connector is asked to transmit signals with higher frequency. Higher frequent signal transmission may generate electrostatic therein. Therefore, the micro coaxial cable connectors with better grounding performance are needed.

U.S. Pat. No. 6,641,435, issued to Ko on Nov. 4, 2003 and entitled with "Vertically mated micro coaxial cable connector assembly", discloses a cable connector assembly including a cable connector and a plurality of micro coaxial cables electrically connecting with the cable connector. The cable connector includes an insulative housing, a plurality of contacts received in the insulative housing, and a shielding shell enclosing the insulative housing. Each of the cables includes a central conductor, an insulative layer enclosing the central conduct, and a metallic braiding layer enclosing the insulative layer. The shielding shell defines a plurality of spring arms mechanically and electrically connecting with the corresponding metallic braiding layers of the cables. Therefore, an electrical connection between the shielding shell and the metallic braiding layers of the cables is established for grounding. However, the electrical connection is so unreliable that it is easy to be broken down and EMI is difficulty prevented.

Hence, a cable connector assembly having better grounding structure is desired.

SUMMARY OF THE INVENTION

Accordingly, an object of the present invention is to provide a cable connector assembly having better grounding performance.

To achieve the above object, a cable connector includes an insulative housing, at least one terminal received in the insulative housing, a metal cover shielding the insulative housing and at least one cable connecting with the at least one terminal. The cable includes a central conductor and a braiding layer coaxially surrounding the central conductor. The braiding layer of the cable and the metal cover are connected with each other by conductive adhesive.

Other objects, advantages and novel features of the invention will become more apparent from the following detailed description when taken in conjunction with the accompanying drawings.

DETAILED DESCRIPTION OF THE PREFERRED EMBODIMENT

Figure 1:
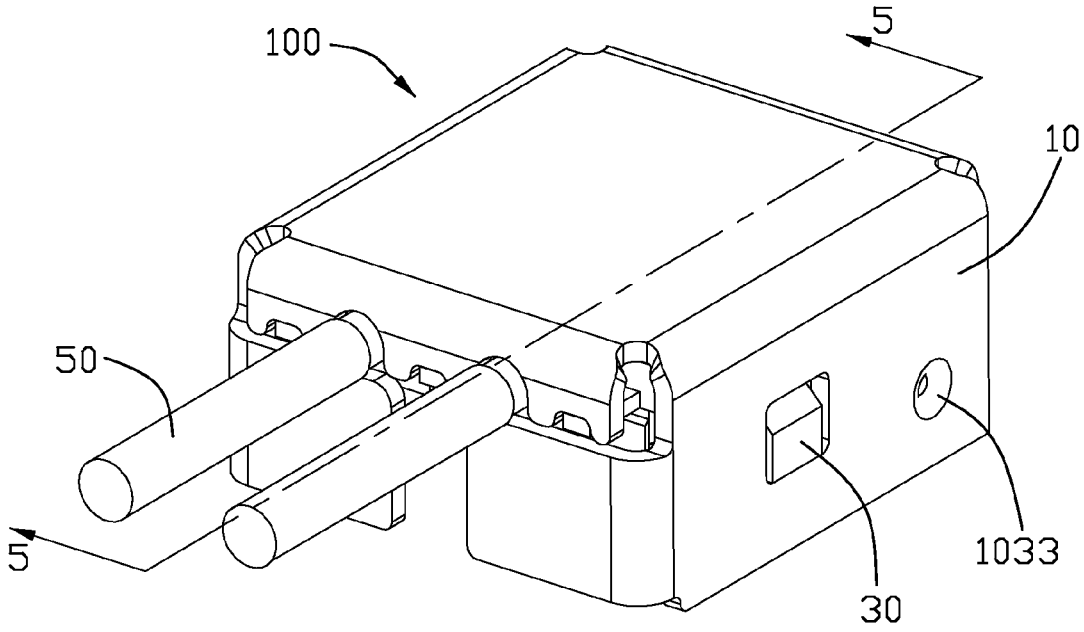
FIG. 1 is a perspective, assembled view of a cable connector constructed in accordance with the present invention of a cable connector assembly.
Figure 2:
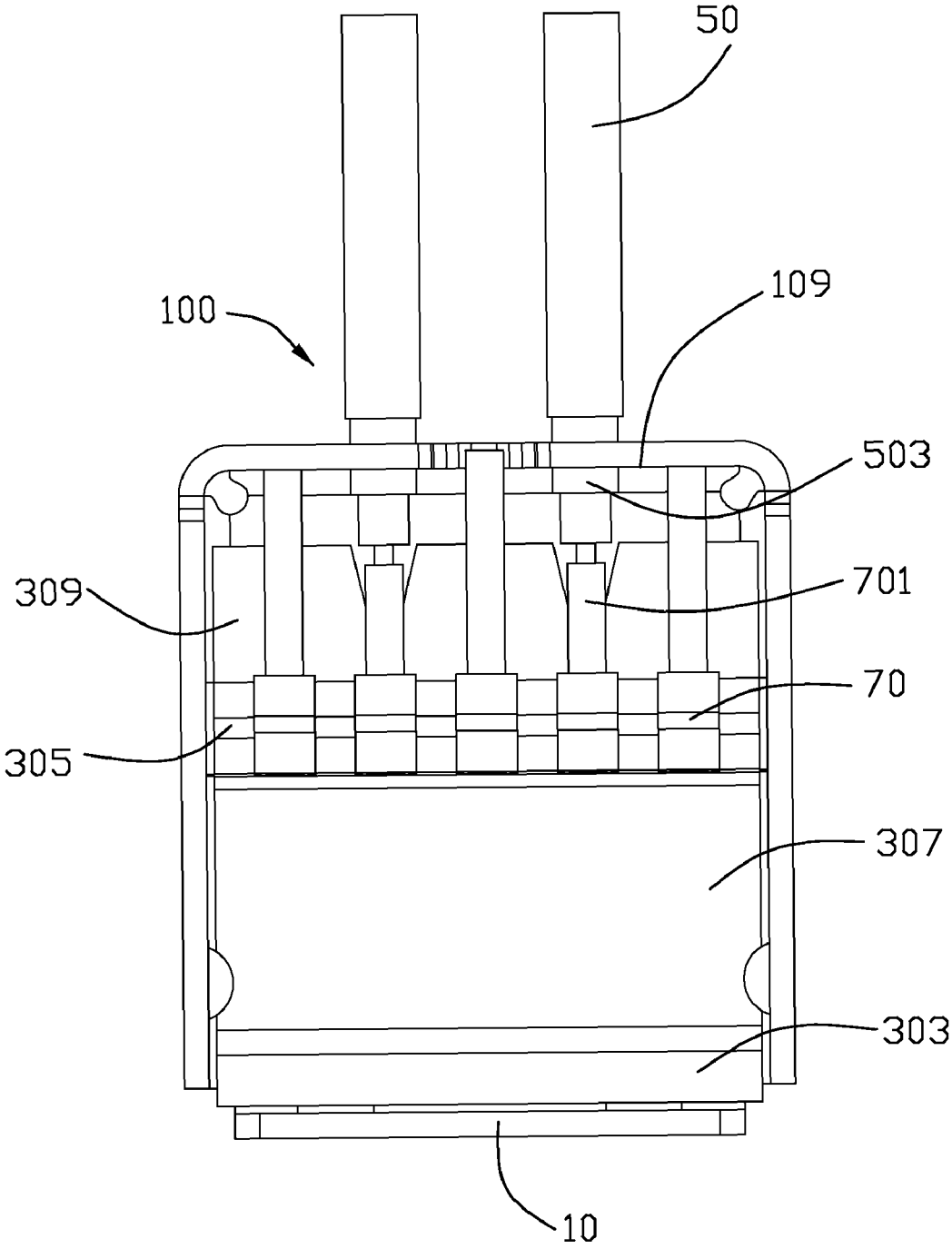
FIG. 2 is a bottom plan view of the cable connector of FIG. 1.

Referring to FIGS. 1-11, a cable connector assembly (not labeled) of the present invention in a first embodiment, comprises a cable connector 100 and a mating connector 200 coupled with the cable connector 100.

Referring to FIGS. 1-6, reference will now be made in detail to a preferred embodiment of the cable connector 100 as following. The cable connector 100 comprises an insulative housing 30, a plurality of terminals 70 received in the insulative housing 30, a metal cover 10 shielding the insulative housing 30, and a plurality of cables 50 connecting to the terminals 70.

Figure 3:
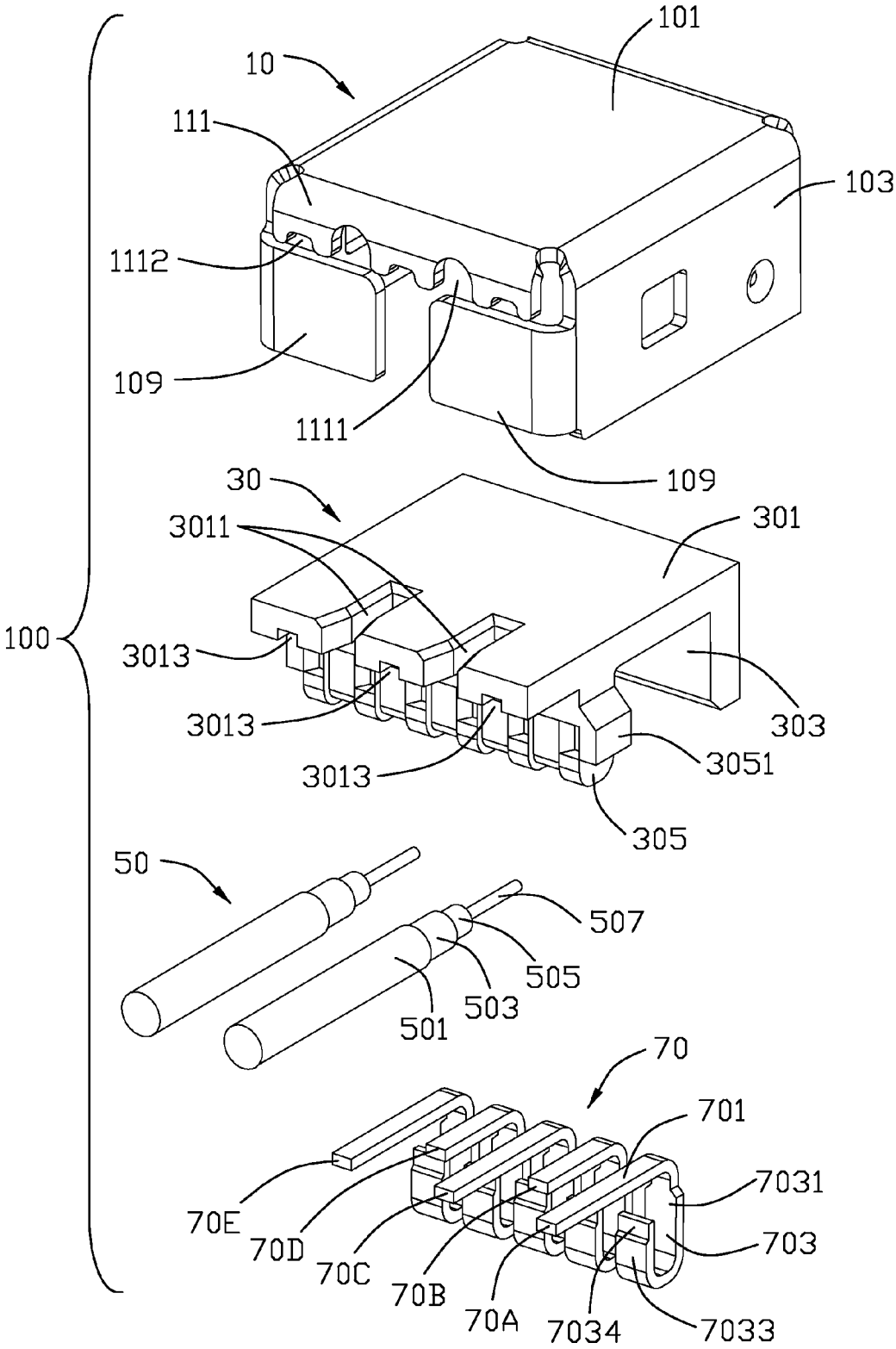
FIG. 3 is a perspective, exploded view of the cable connector of FIG. 1.
Figure 4:
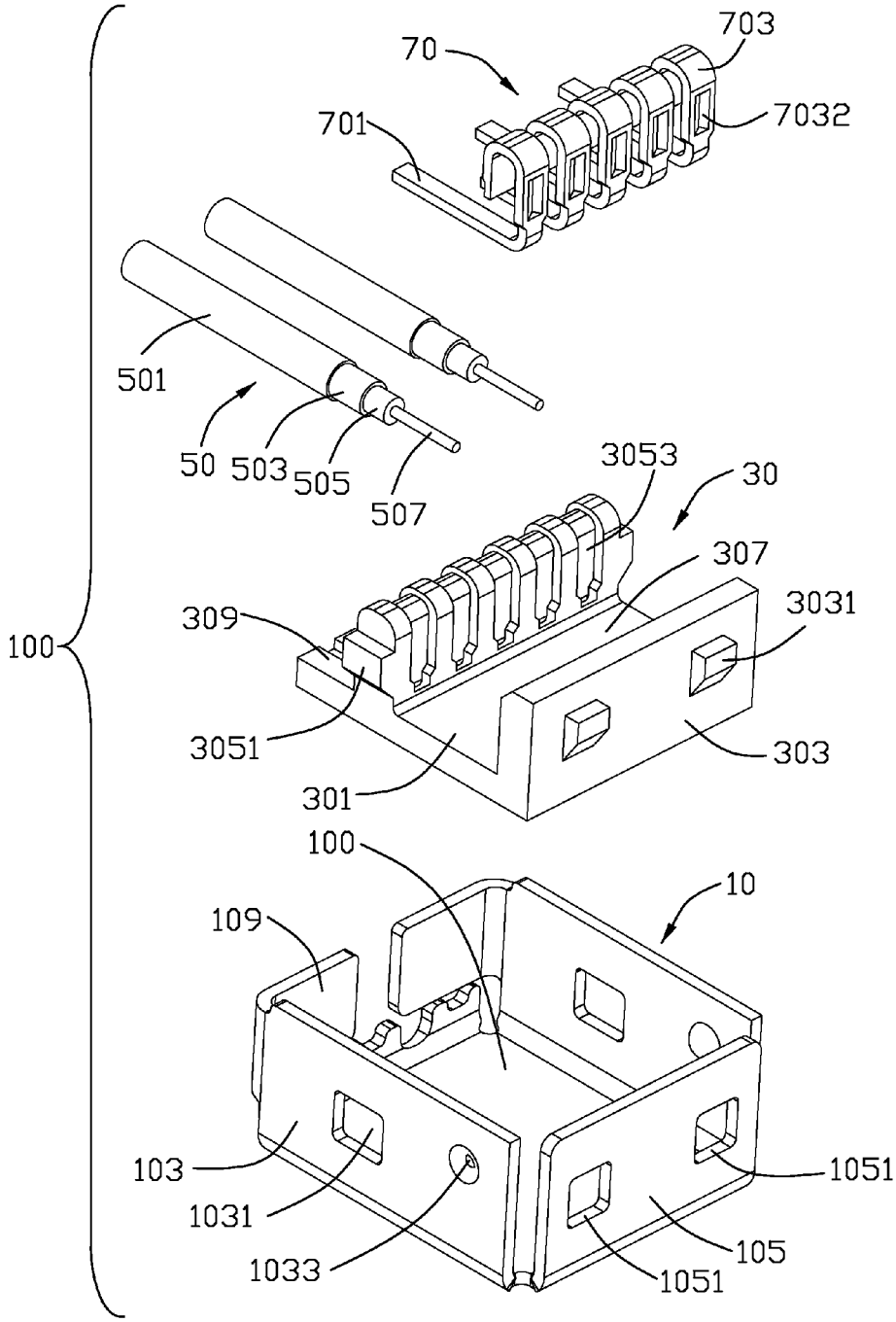
FIG. 4 is a view similar to FIG. 3 but taken from a different aspect.
Figure 5:
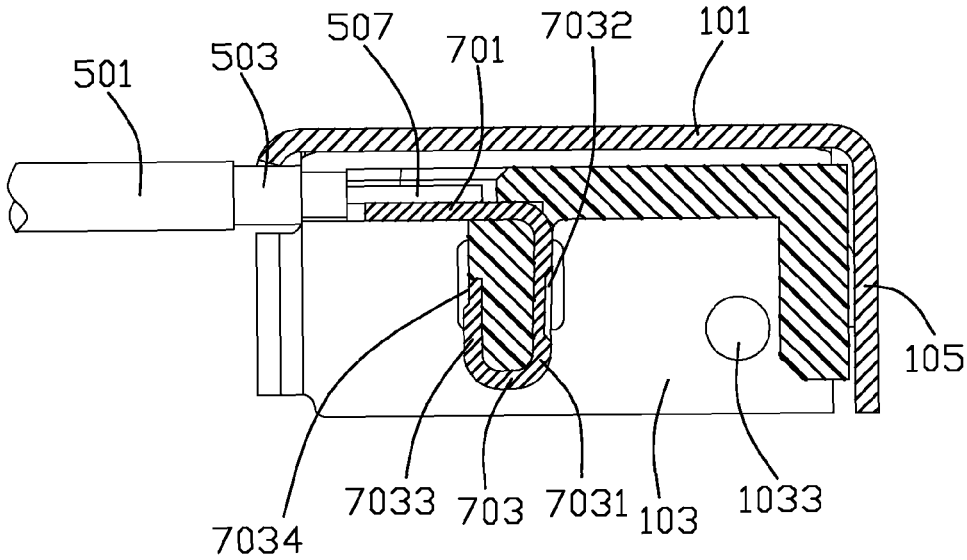
FIG. 5 is a cross-section view of the cable connector taken along line 5-5.

Referring to FIGS. 3 and 4, the insulative housing 30 comprises a planar base portion 301 having a first end (not labeled) and a second end (not labeled) opposite to the first end, a guiding portion 303 vertically extending from the first end of the base portion 301 for guiding the cable connector 100 to mate with the mating connector 200 in a right position, and a mating portion 305 vertically extending from a middle part of the base portion 301. The mating portion 305 is substantially parallel to the guiding portion 303 and especially extends along a same side as the guiding portion 303 relative to the base portion 301 to define a receiving channel 307 with three openings thereof. The base portion 301 and the mating portion 305 cooperatively define a receiving space 309 with four openings thereof, which is located in a neighborhood of the receiving channel 307. The guiding portion 303 forms a pair of first protrusions 3031 extending outwardly and forwardly therefrom while the mating portion 305 forms a pair of second protrusions 3051 extending laterally and outwardly for mating with the metal cover 10. Because the first protrusions 3031 and the second protrusions 3051 are just used for engagement between the insulative housing 30 and the metal cover 10, no essential difference is formed therebetween. The mating portion 305 is concaved from top surfaces thereof for several intervals as a plurality of terminal channels 3053. The terminals 70 harness on the mating portion 305 to be partly received in the terminal channels 3053. The base portion 301 defines a plurality of slits 3011 and a plurality of slots 3013 at the second end thereof. The slits 3011 are dilacerated from the base portion 301 while the slots 3013 are recessed from the base portion 301. Each slit 3011 is alternately located beside the slot 3013. Both the slits 3011 and the slots 3013 extend lengthwise to communicate with the terminal channels 3053.

Referring to FIGS. 2-5, the terminal 70 comprises three grounding pins 70A, 70C, 70E received in the slots 3013 and two signal pins 70B, 70D received in the slits 3011. Accordingly, the grounding pins 70A, 70C, 70E and the signal pins 70B, 70D are alternately located. The grounding pins 70A, 70C, 70E and the signal pins 70B, 70D have similar structures, each comprising a soldering portion 701 connecting with the cable 50 and an annular portion 703 extending vertically from the soldering portion 701 with a free end thereof extending towards the soldering portion 701. The annular portion 703 has a width larger than the soldering portion 701. The annular portion 703 comprises a first arm portion 7031 connecting with the soldering portion 701 and a second arm portion 7033 curvedly and inversely extending from the first arm portion 7031. The first arm portion 7031 recesses from an outer surface thereof to be a first contact portion 7032 and the second arm portion 7033 recesses at a free end thereof to be a second contact portion 7034. Taken a side view of the terminal 70, the first and second contact portions 7032, 7034 have opposite exposure. The grounding pins 70A, 70C, 70E differentiate from the signal pins 70B, 70D merely at that the soldering portions 701 of the grounding pins 70A, 70C, 70E are longer than the soldering portions 701 of the signal pins 70B, 70D.

Referring to FIGS. 1-5, the metal cover 10 is box structured and comprises a top wall 101, a pair of sidewalls 103, a rear wall 105, and a pair of front walls 109. The sidewalls 103 and the rear wall 105 respectively and vertically extend from a left side, a right side, and a rear side of the top wall 101. Each sidewall 103 defines a square-shaped fixing hole 1031 in middle part thereof for receiving the second protrusion 3051 of the insulative housing 30. Furthermore, each sidewall 103 forms a hemispherical heave 1033 adjacent to the square-shaped fixing hole 1031. The hemispherical heaves 1033 are exposed in the receiving channel 307 for interference with the mating connector 200 when assembling. The rear wall 105 defines a pair of openings 1051 respectively receiving the first protrusions 3031 of the insulative housing 30. The front walls 109 extend laterally and oppositely from the sidewalls 103. The top wall 101 further comprises a gate portion 111 located above the front walls 109. The gate portion 111 defines a plurality of first grooves 1111 for the cable 50 going through and a plurality of second grooves 1112 for the grounding pins 70A, 70C, 70E going through. The first grooves 1111 and the second grooves 1112 are alternatively located corresponding to the signal pins 70B, 70D and the grounding pins 70A, 70C, 70E.

Referring to FIGS. 3 and 4, the cables 50 are micro coaxial cables, each comprising a central conductor 507 for signal transmission, an insulating layer 505 encircling the central conductor 507, a braiding layer 503 shrouding the insulating layer 505, and a jacket 501 wrapping the braiding layer 503. The cross sections of the central conductor 507, the insulating layer 505, the braiding layer 503, and the jacket 501 become larger and larger one by one. The cables 50 are partly received in the slits 3011 and partly extend out of the metal cover 10 through the first grooves 1111. The central conductors 507 are soldered with the soldering portions 701 of the signal pins 70B, 70D.

Figure 6:
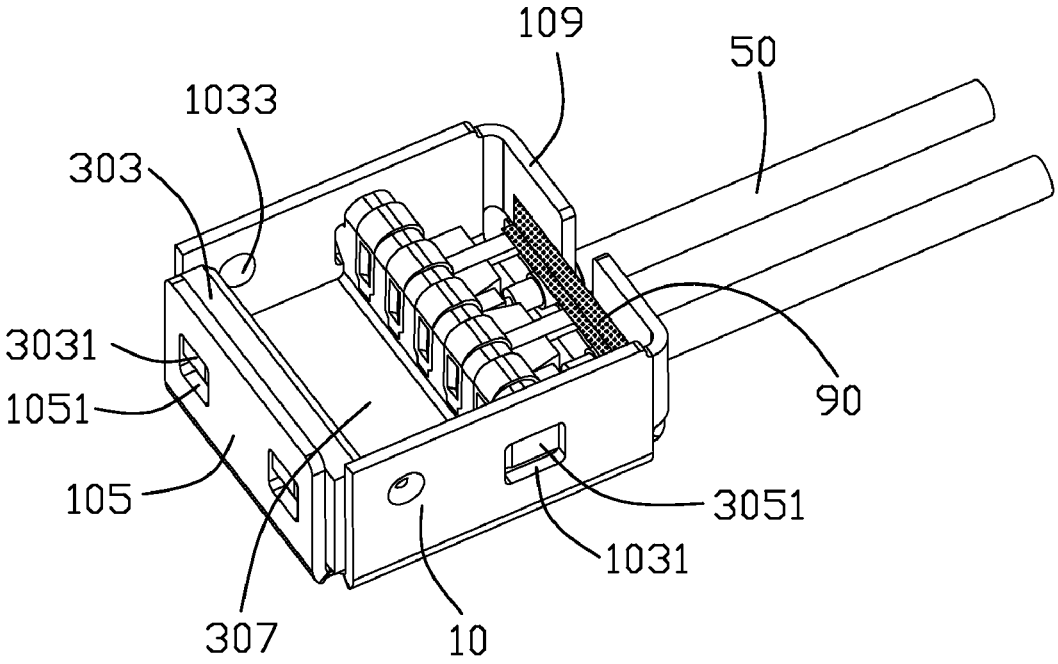
FIG. 6 is a view of the cable connector with the conductive material adhered thereto.

Referring to FIG. 6, conductive material 90, such as conductive adhesive, is attached to the inner sides of the front walls 109 to connect with the grounding pins 70A, 70C, 70E, the braiding layers 503 of the cables 50 and the metal cover 10. Electrical connection is achieved therebetween and electrostatic is better discharged thereby.

Figure 7:
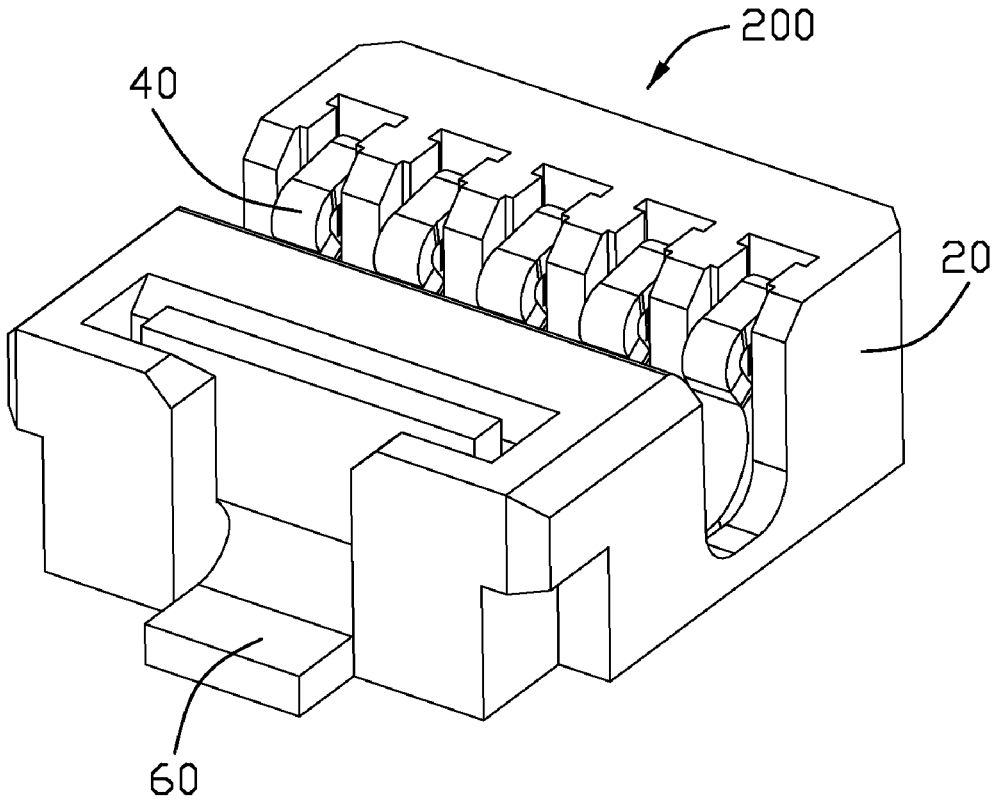
FIG. 7 is a perspective, assembled view of a mating connector coupled with the cable connector.

Following, please refer to FIGS. 7-9, reference will now be made in detail to a preferred embodiment of the mating connector 200. The mating connector 200 comprises an insulative base 20, a plurality of contacts 40 received in the insulative base 20, and a reinforcing element 60 fixed at a side of the insulative base 20.

Figure 8:
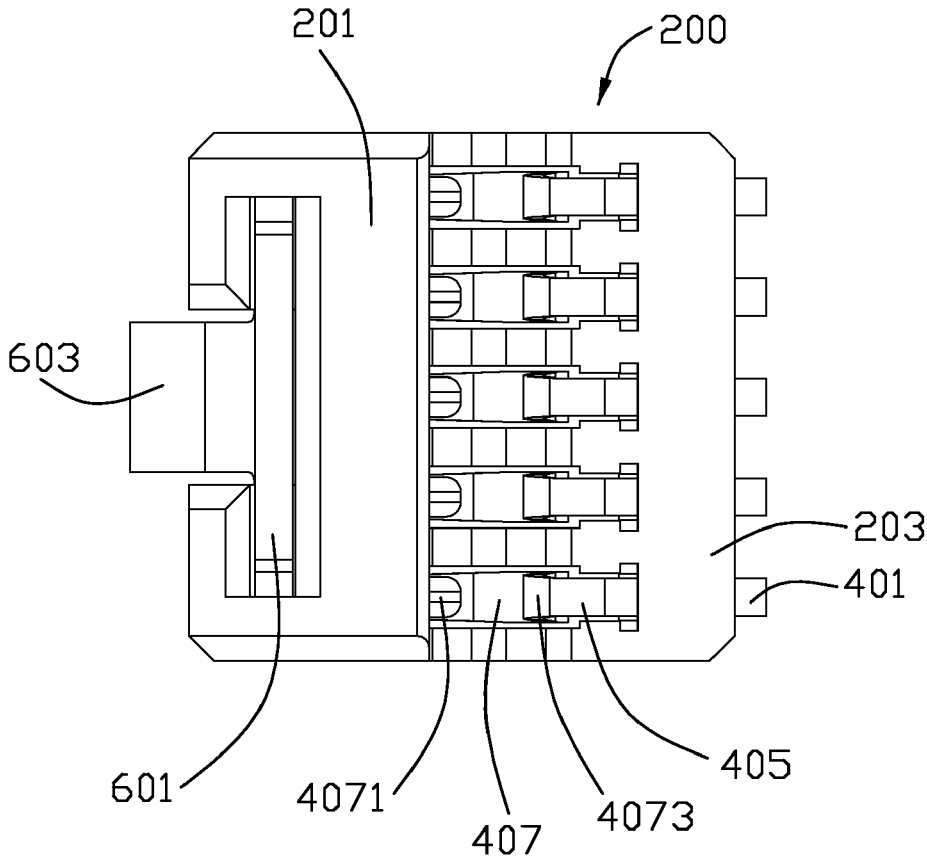
FIG. 8 is a top plan view of the mating connector of FIG. 7.
Figure 9:
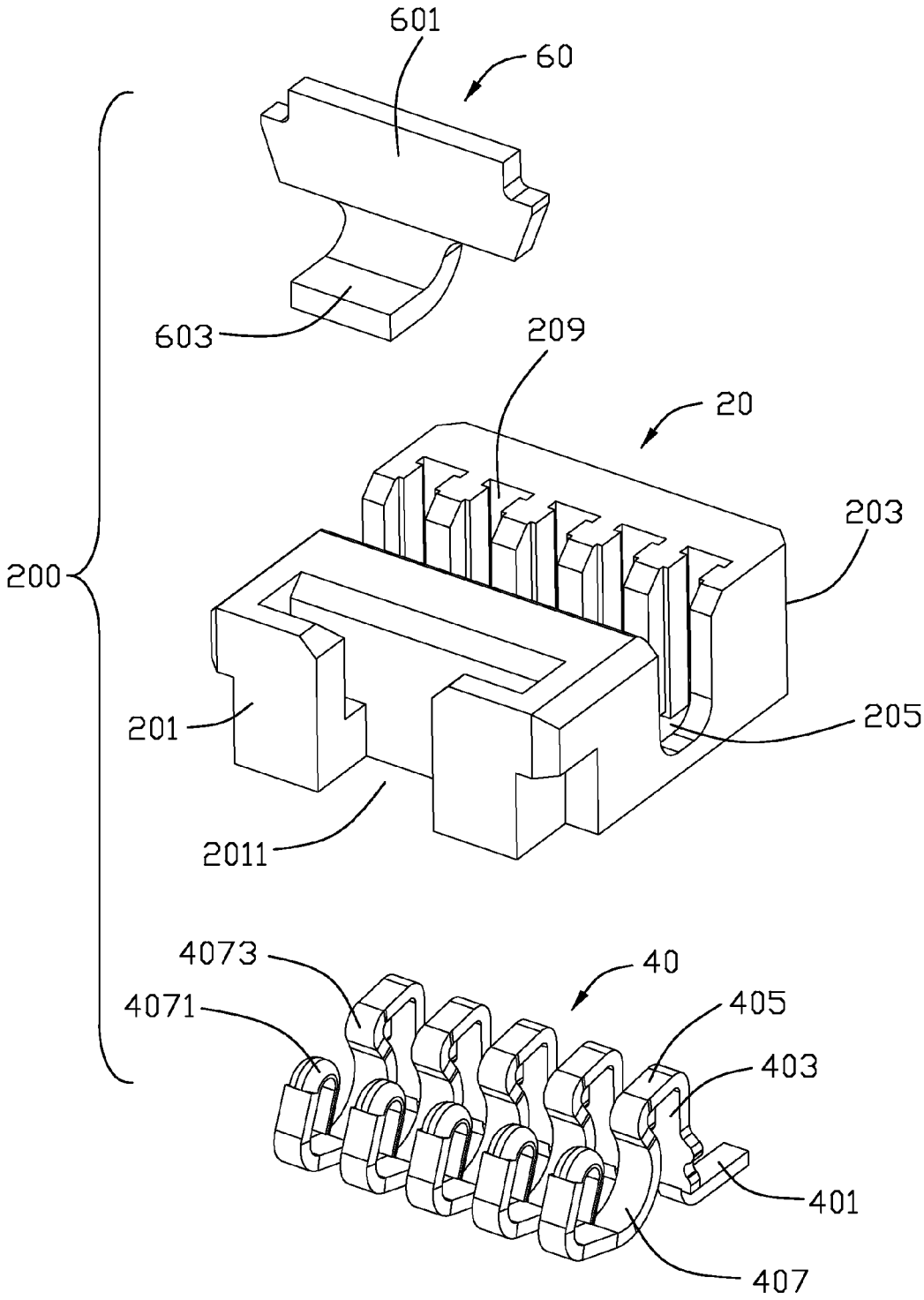
FIG. 9 is a perspective, exploded view of the mating connector of FIG. 7.

Referring to FIGS. 8-9, the insulative base 20 comprises a receiving bar 203 and an assembling bar 201 integrally with the receiving bar 203. The receiving bar 203 defines a receiving room 205 from an upper surface thereof for mating with the cable connector 100 and a plurality of passageways 209 communicating with the receiving room 205. The contacts 40 are partly received in the passageways 209 and partly exposed in the receiving room 205. The assembling bar 201 defines an approximately T-shaped cut 2011 for buckling the reinforcing element 60. The reinforcing element 60 comprises a transverse arm 601 fully received in the T-shaped cut 2011 and a longitudinal arm 603 slantwise extending from the transverse arm 601 and extending out of the insulative base 20.

Figure 11:
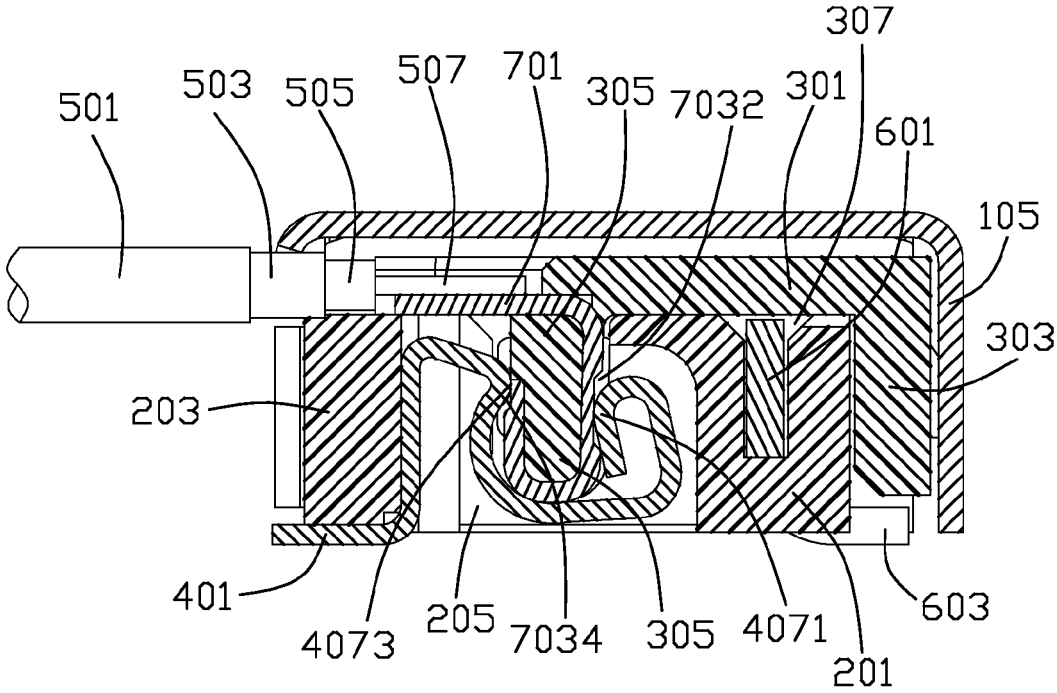
FIG. 11 is a cross-section view of the cable connector assembly of FIG. 10 in which the metal cover of the cable connector is shown.

Referring to FIGS. 8-9 and 11, each contact 40 comprises a soldering part 401 extending horizontally for connection with a printed circuit board (PCB, not shown), a fixing part 403 extending vertically and upwardly from the soldering part 401 for fastening the contact 40 in the insulative base 20, a flexible part 407 curvedly subtending the fixing part 403, and a planar part 405 connecting with the fixing part 403 and the flexible part 407 in a peak position thereof. The soldering part 401, the fixing part 403, and the planar part 405 cooperate with the flexible part 407 to appear as a cap. The flexible part 407 defines a U-shaped receptacle for the receiving terminal 70 of the cable connector 100. The flexible part 407 forms an inflexed part 4073 at a conjoining section with the planar part 405, and a contact part 4071 slantways facing towards the inflexed part 4073 at a free end thereof. In assembling the contact 40 into the insulative base 20, the fixing part 403 is received in the passageways 209 of the insulative base 20 while the contact part 4071 and the inflexed part 4073 are exposed in the receiving room 205 for contacting with the terminal 70 of the cable connector 100.

Figure 10:
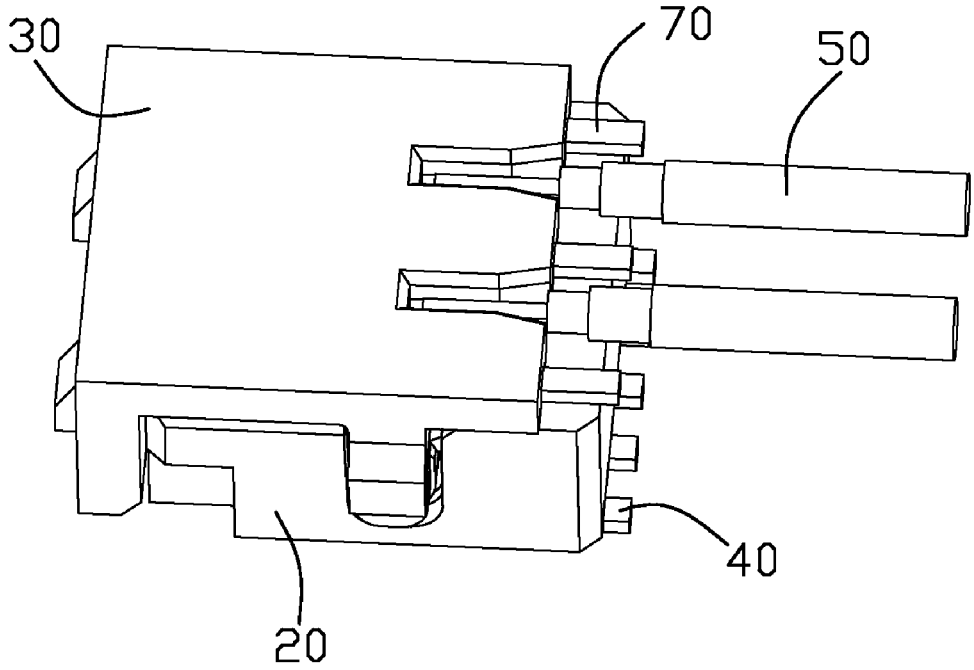
FIG. 10 is a perspective, assembled view of the cable connector assembly according to the prevent invention, without the metal cover of the cable connector.

Referring to FIGS. 10-11, after assembling the cable connector 100 on the mating connector 200, the metal cover 10 fully shields over the mating connector 200. The guiding portion 303 is securely sandwiched between the assembling bar 201 of the insulative base 20 and the rear wall 105 of the metal cover 10. The receiving channel 307 of the first connector 100 is intersectant with the receiving room 205 of the second connector 200. In detail, the assembling bar 201 is received in the receiving channel 307 and the mating portion 305 of the cable connector 100 is received in the receiving room 205. In detail, each terminal 70 harnessing on the mating portion 305 is inserted into the U-shaped receptacle defined by the flexible part 407 of the contact 40. The contact part 4071 and the inflexed part 4073 are respectively located at different sides of the terminal 70. The contact part 4071 of the contact 40 mechanically and electrically contacts the first contact portion 7032 while the inflexed part 4073 of the contact 40 mechanically and electrically contacts the second contact portion 7034.

The cable connector 100 of the present invention is coupled with the mating connector 200 in a board-to-board manner, the mating connector 200 is soldered with the PCB and the cable connector 100 comprises signal pins 70B, 70D, and a plurality of cables 50 connecting with the signal pins 70B, 70D for signal transmission. Because the cables 50 are micro coaxial cables, the present invention can transmit high frequent signals. The numbers of the cables 50 and the corresponding signal pins 70B, 70D are two in this embodiment, the present invention alternatively comprises more than two cables 50 and more than two signal pins 70B, 70D to meet with multi-functions of users. Another, because the first and second contact portions 7032, 7034 are both recessed from surfaces of the terminal 70, the contact part 4071 and the inflexed part 4073 of the contact 40 firmly contact with the first and second contact portions 7032, 7034 to prevent deviation therebetween. Moreover, the grounding pins 70A, 70C, 70E, the braiding layers 503 of the cables 50 and the metal cover 10 are connected with each other through conductive material 90 and better grounding preference is achieved.

Figure 12:
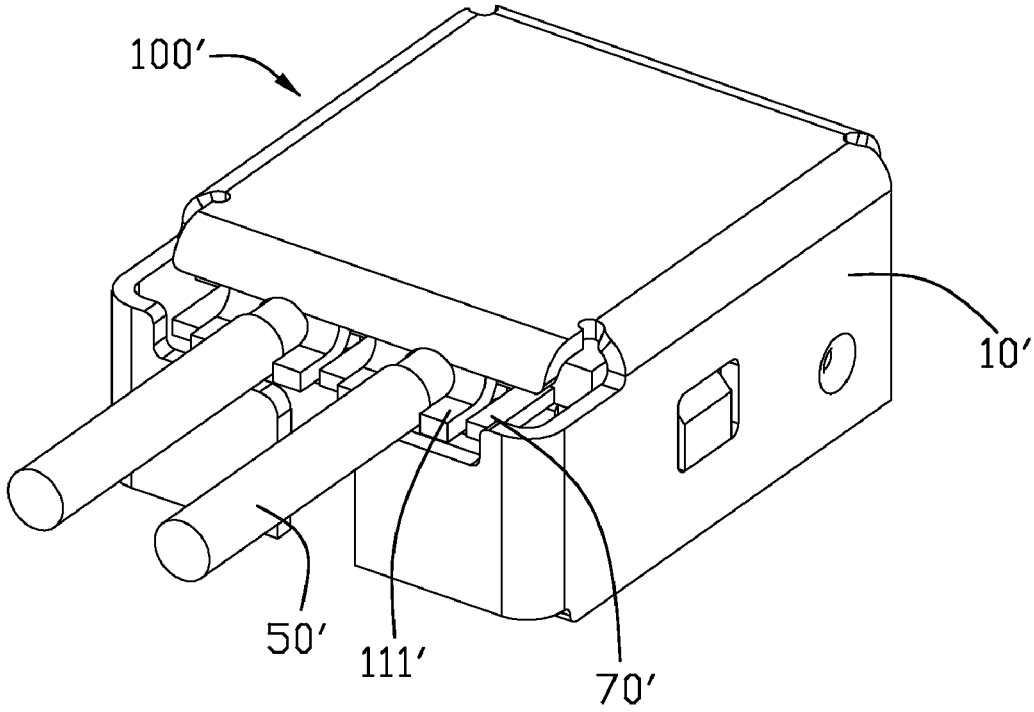
FIG. 12 is a perspective, assembled view of an alternative cable connector constructed in accordance with the present invention.
Figure 13:
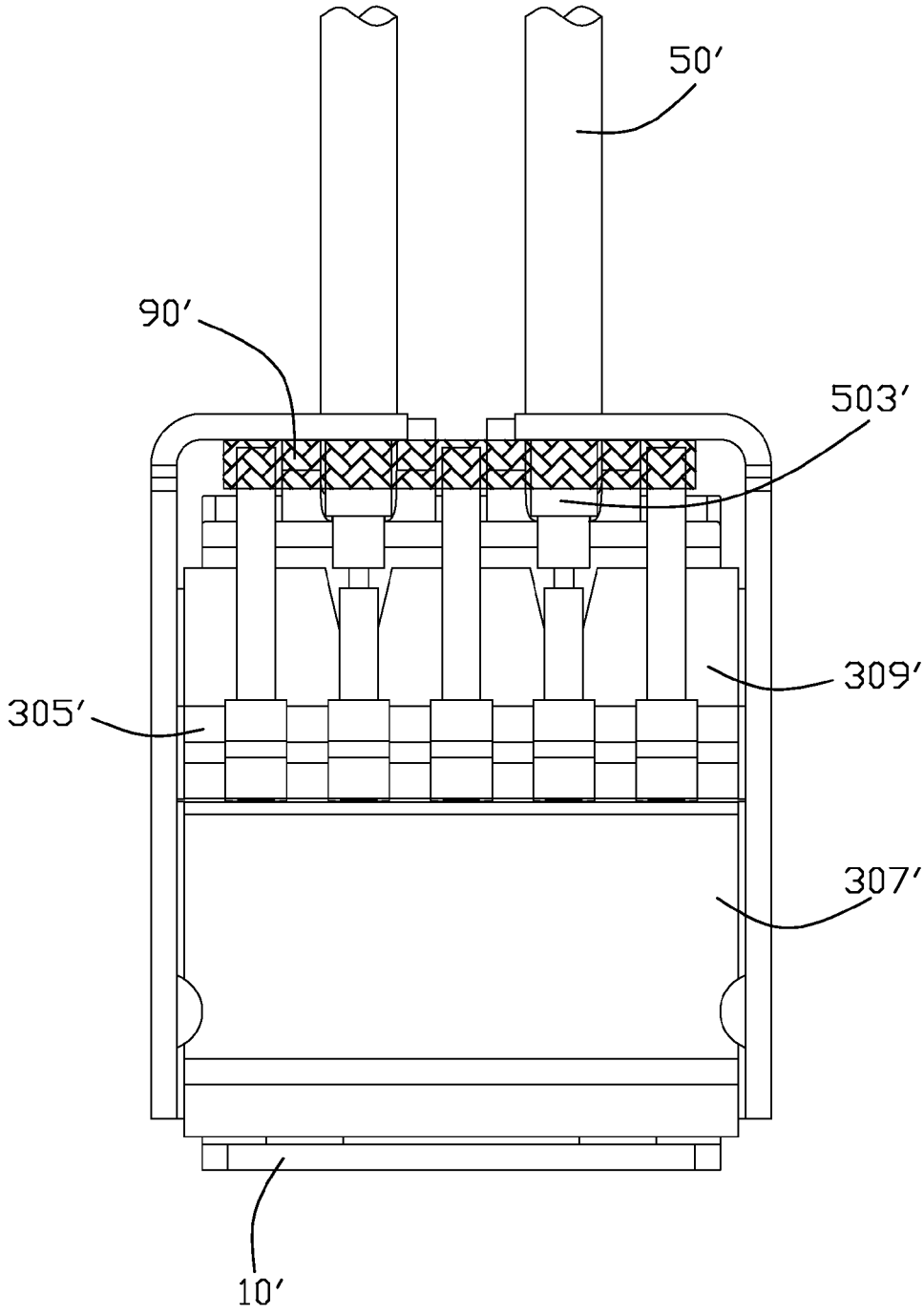
FIG. 13 is a bottom plan view of the alternative cable connector of FIG. 12 with the conductive material adhered thereto.
Figure 14:
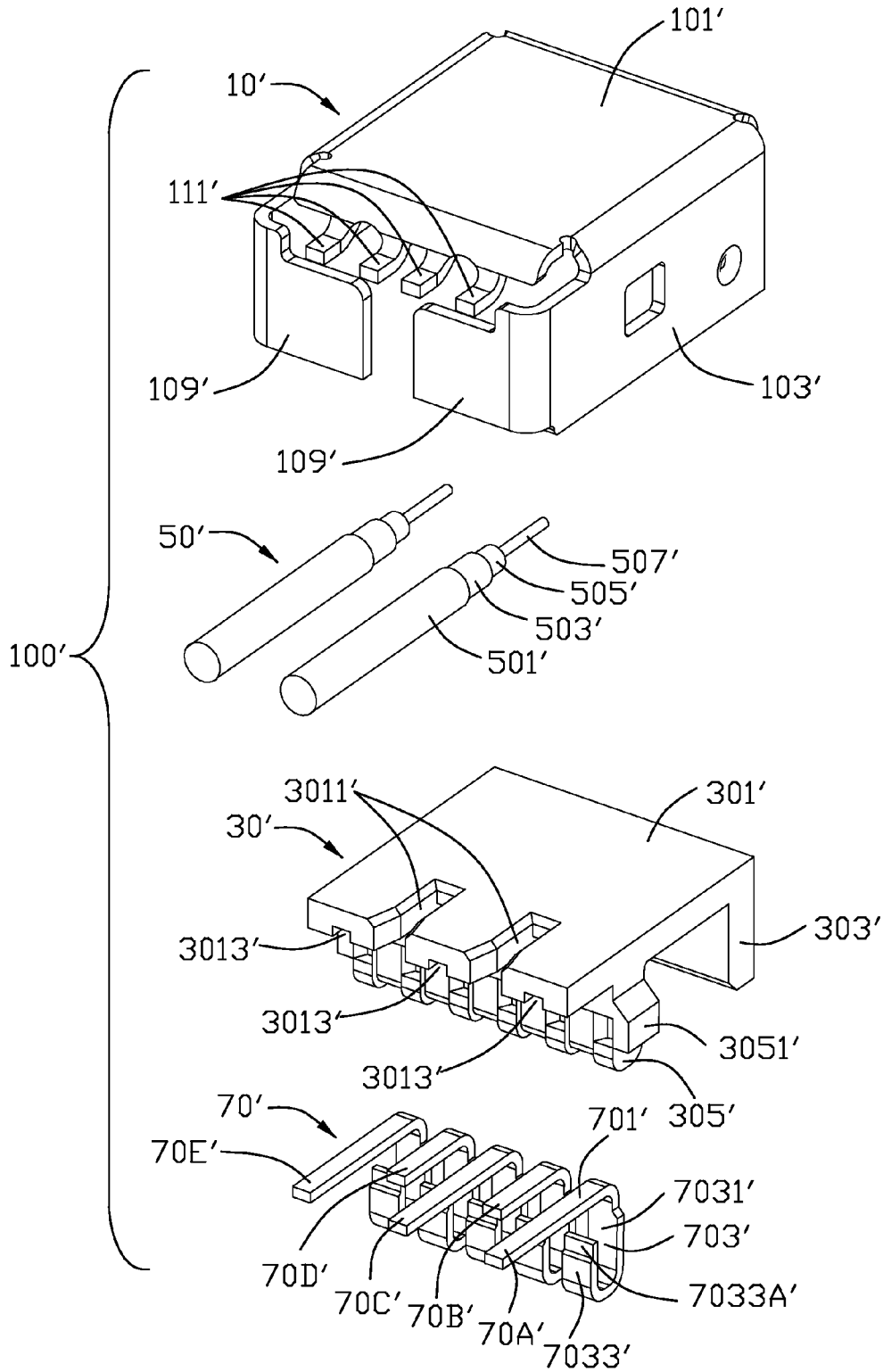
FIG. 14 is a perspective, exploded view of the alternative cable connector of FIG. 12.

Referring to FIGS. 12-14, a cable connector 100' in a second embodiment comprising an alternative metal cover 10' is described. The metal cover 10' comprises a top wall 101', a pair of sidewalls 103', a rear wall 105', and a pair of front walls 109'. The sidewalls 103', the rear wall 105' and the front walls 109' are all same as those of the metal cover 10 of the cable connector 100 in the first embodiment. The top wall 101' further comprises a plurality of soldering pads 111' extending forwardly towards the front walls 109' but not achieves the front walls 109'. In assembly, the soldering pads 111' of the metal cover 10', the soldering portions 701' of the grounding pins 70A', 70C', 70E' and the braiding layers 503' of the cables 50' are arranged in a same level and connect with each other by conductive material 90' to achieve electrical connection.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable connector assembly, comprising:

a first connector comprising:

an insulative housing;

a plurality of terminals received in the insulative housing, each terminal comprising a soldering portion and a contact portion, the terminals including a plurality of signal pins and at least one grounding pin;

a metal cover shielding the insulative housing;

a plurality of cables connecting with the signal pins, each cable comprising a central conductor connecting to the soldering portion of the signal pin and a braiding layer coaxially surrounding the central conductor; and conductive adhesive connecting the at least one grounding pin, the braiding layers of the cables and the metal cover with each other; and a second connector coupled with the first connector, comprising:

an insulative base defining a receiving room and a plurality of passageways communicating with the receiving room; and a plurality of contacts received in the passageways and partly exposed in the receiving room, each contact forming a flexible part defining a receptacle capable of receiving the contact portion of the terminal and a soldering part for connection with a printed circuit board; wherein the insulative housing comprises a mating portion and the contact portion of the terminal harnesses on the mating portion;

the insulative housing comprises a guiding portion spaced apart from the mating portion and a receiving channel is defined between the guiding portion and the mating portion;

the receiving channel is intersectant with the receiving room when the first connector and the second connector are coupled with each other; and the insulative base of the second connector comprises an assembling bar received in the receiving channel of the first connector.

2. The cable connector assembly as described in claim 1, wherein the second connector comprises a reinforcing element and the assembling bar defines a cut receiving the reinforcing element.

3. The cable connector assembly as described in claim 1, wherein the mating portion of the first connector is received in the receiving room of the second connector.

4. A cable connector assembly comprising:

an insulative housing defining a base portion defining opposite first and second surfaces thereof with having a mating portion extending from the first surface in a first direction to form a mating port thereabouts;

a plurality of contacts each having a contacting section grasping upon the mating portion for mating with a terminal of a complementary connector which is mated within the mating port, and a tail section essentially extending along the base portion in a second direction perpendicular to said first direction;

a plurality of slits formed in the base portion and extending along said second direction, said slits also extending through the second surface and respectively aligned and communicating with the corresponding tail sections of the contacts in said first direction;

a plurality of cables each having an inner conductor received in the corresponding slit and soldered to the corresponding tail section; and a metallic shell assembled to the housing and having at least a top wall intimately covering at the second surface of the housing under condition that said inner conductor is located between said top wall and the second surface of the base portion.

5. The cable connector assembly as claimed in claim 4, wherein said housing further includes a guiding portion essentially parallel to the mating portion and cooperating with said mating portion to form said mating port.

6. The cable connector assembly as claimed in claim 4, wherein said shell further includes at least one front wall extending in a plane defined by the first direction and a third direction perpendicular to both said first direction and said second direction, under condition that said front wall restrains said cables from moving along said first direction.

7. The cable connector assembly as claimed in claim 6, wherein said shell is assembled to the housing along said first direction before said front wall is bent to a final position so as to avoid interference between the cables and the front wall during assembling.

8. The cable connector assembly as claimed in claim 4, wherein the tail sections of the contacts which are soldered to the corresponding cables, provide corresponding connecting faces, for soldering to the corresponding cables, directing to the top wall in a third direction opposite to said first direction while those of the contacts which are not soldered to the corresponding cables, provide corresponding connecting faces, for electrically grounding to the shell, directing away from the top wall in said first direction.

* * * * *